United States Patent [19]

Morris et al.

[11] Patent Number: 4,571,901

[45] Date of Patent: Feb. 25, 1986

[54] VANDAL-RESISTANT SECURITY VIEW PORT

[75] Inventors: Earl L. Morris, La Habra Heights; V. Walter Hafner, Whittier, both of Calif.

[73] Assignee: Acorn Engineering Company, City of Industry, Calif.

[21] Appl. No.: 590,565

[22] Filed: Mar. 16, 1984

[51] Int. Cl.[4] ..... E04H 3/08

[52] U.S. Cl. ..... 52/106; 52/204; 49/171

[58] Field of Search ..... 52/204, 213, 106; 49/171, 169, 50

[56] References Cited

U.S. PATENT DOCUMENTS

| | | | |
|---|---|---|---|
| 1,747,156 | 2/1930 | Breslow | 49/171 |
| 2,771,971 | 11/1956 | Goldberg | 52/204 |
| 3,173,180 | 3/1965 | Dean | 52/204 |
| 3,203,052 | 8/1965 | Curtis, Jr. | 49/171 X |

*Primary Examiner*—Carl D. Friedman
*Assistant Examiner*—Creighton Smith
*Attorney, Agent, or Firm*—Edgar W. Averill, Jr.

[57] ABSTRACT

A vandal-resistant security view port for use in prison cells and the like. The view port permits observation into a cell or room and is mounted on a frame which can be attached over an opening in a wall of the cell. The view port has a transparent pane and a grate and may be open or covered by a hinged door operable from the back side of the wall.

14 Claims, 8 Drawing Figures

VANDAL-RESISTANT SECURITY VIEW PORT

BACKGROUND OF THE INVENTION

The field of the invention is prison apparatus and the invention relates more particularly to view ports or observation panels useful in prisons, mental institutions and other locations requiring a high degree of security.

View ports have been used in prison doors since the early days of prison construction. Such view ports were typically a solid plate which could be opened or closed from outside of the door of the cell. The plate was either hinged or provided with means for sliding and was locked or latched from outside of the cell. More recently, a lens member was added but basically view ports are still typically installed in cell doors and operated from the front surface of the door. In many prisons, the cell door is not readily accessible without passing through a guard station outside of a corridor which leads to a group of cells. Thus, in order to view the interior of a cell, it was necessary to pass through an additional guard station. Prisons invariably have a pipe chase which is a corridor located along a wall of the cell which is most commonly the opposite wall from the prison door. This pipe chase is often accessible without the necessity of passing through the additional guard station required to reach the cell door. Because of the wall thickness and the perceived difficulty and expense of installing a view port in a wall, installation in the wall between the cell and the pipe chase had been considered impractical.

SUMMARY OF THE INVENTION

It is an object of the present invention to provide a security view port installed in a cell wall adjacent a pipe chase.

The present invention is for a vandal-resistant security view port assembly to permit observation into a cell. The view port has a frame having means for attachment over an opening in a wall. The frame has a front plate having at least one opening therethrough said front plate having a cell facing surface and a chase facing surface. Fastening means are affixed to the front plate near the opening. Pan means are affixed to the chase facing surface of the front plate by the fastening means and the pan means has at least one opening therethrough. Door means are hingedly held so that they are moveable between a first position when the door means covers the opening in the pan means and a second position where it permits viewing through such opening. Lens means are held against the chase surface of the front plate by the pan means and the lens means completely covers and extends past the opening in the front plate. Preferably, the lens means is positioned by the fastening means in the desired location. Furthermore, it is preferable that the frame be bolted to the cell wall by bolts extending through tubes formed in the wall. In the event that the lens becomes broken or the view port otherwise needs servicing, the view port is removable and serviceable from outside of the cell and this operation may be performed from the pipe chase without the necessity of entering the cell.

DESCRIPTION OF THE PREFERRED EMBODIMENTS

Figure 1:
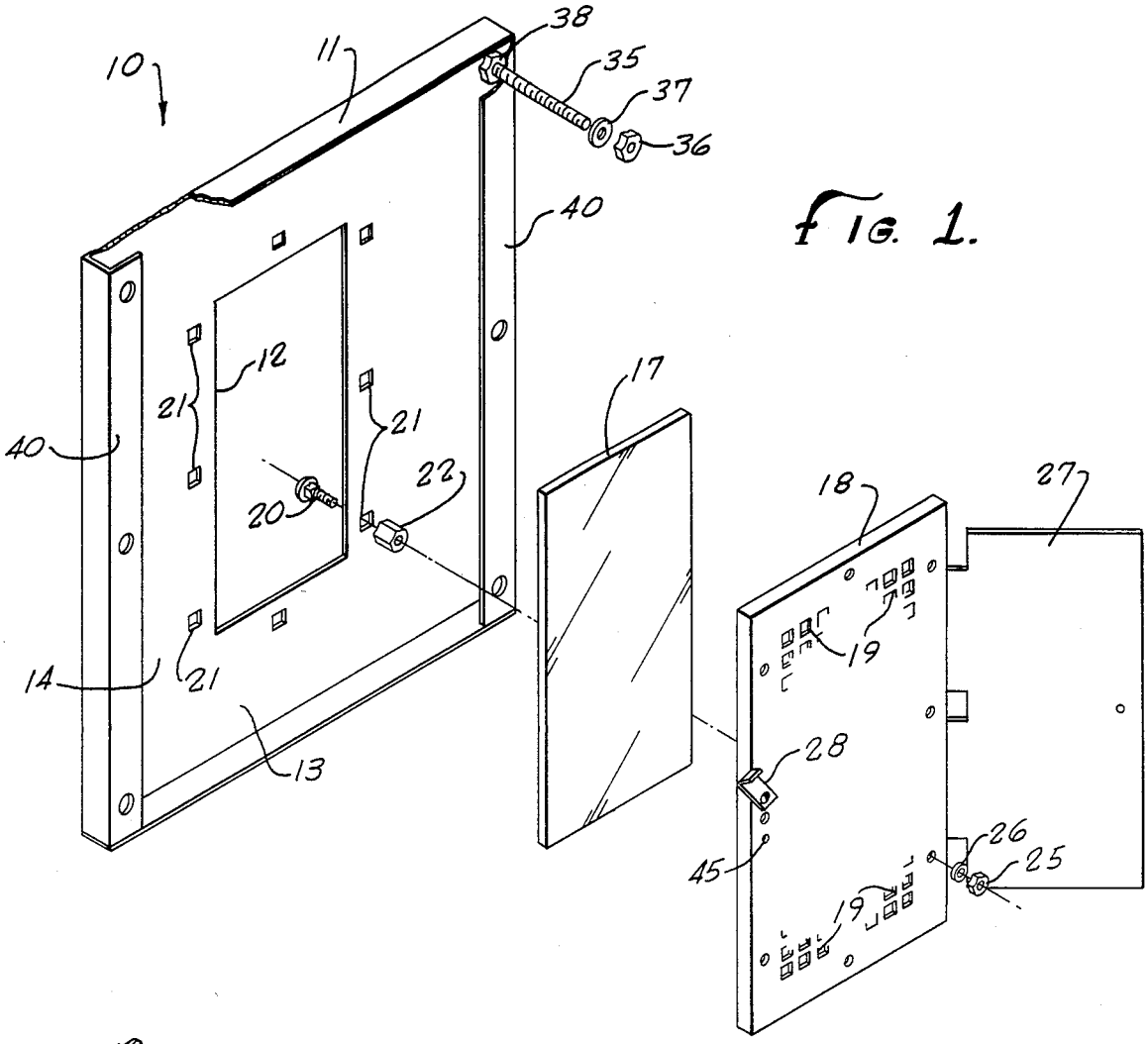
FIG. 1 is an exploded perspective view of the view port of the invention as viewed from the chase side.
Figure 2:
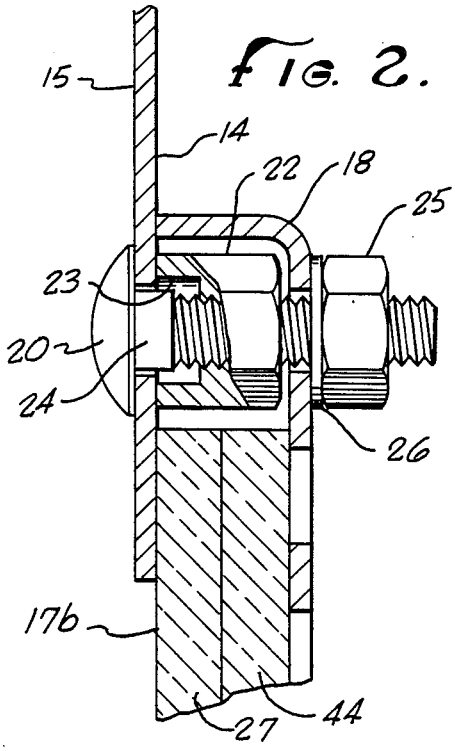
FIG. 2 is an enlarged fragmentary view of the fastening means of the view port of FIG. 1.

The view port of the present invention is shown in exploded view in FIG. 1 and indicated generally by reference character 10. View port 10 has a frame 11 which may be fastened to a cell wall over an opening therein as described more fully below. Frame 11 has a generally rectangular opening 12 in the front plate 13 thereof. Frame 11 has a chase or back surface 14 which faces the pipe chase which is accessible to service personnel. As shown in FIG. 2, frame 11 also has a front surface or cell surface 15 which is exposed to the interior of the cell.

Lens 17 is held over opening 12 and all sides of lens 17 extend past the sides of opening 12 so that it is not possible to pass any objects through the opening in frame 11. Lens 17 should be made from a relatively thick transparent sheet such as $\frac{1}{4}$ inch acrylic or polycarbonate plastic or glass. Lens 17 may not only be made from glass or plastic but can be made from a combination or laminate of both. Tempered glass has four to five times the strength of comparable plate glass. It is extremely difficult to break and, if when, will crumble into small rounded crystals having substantially reduced cutting capability. Alternatively, plastics such as those made from acrylic polymer such as that sold under the trademark "Plexiglass" provides a virtually unbreakable lens. Plastics are, of course, subject to scratching. A laminate having a cell surface of tempered glass laminated to or held against a layer of acrylic polymer provides a scratch-free highly transparent combination. An even more structurally strong polymer is made from polycarbonate polymer. This lens is subject to scratching but is capable of providing an extremely strong unbreakable lens.

Lens 17 is held over opening 12 by pan 18 which is preferably fabricated from stainless steel. Pan 18 should be constructed from a strong material since it provides security in the event the lens is broken or otherwise removed. Stainless steel of 14 gauge, type 304 has proved very satisfactory for this application. Pan 18 has a plurality of openings 19. Square openings $\frac{7}{8}$ inch wide, on one inch centers have proved particularly effective although other sizes and shapes of openings may also be used. In the particular configuration shown in FIG. 1, the grate is located in the pan but it is also possible, as pointed out below, that the grate be formed in the front plate 13 of the frame and the opening in pan 18 would then be a rectangular opening. Pan 18 is held to frame 11 by a plurality of bolts 20 which pass through holes 21 formed in the front plate 13 of the frame 11. Bolts 20 are preferably carriage bolts which have a square shank 24 adjacent the head. The square shank 24 fits into square holes 21 and prevents the turning of bolts 20 from the cell side 15. While bolts 20 are the preferred method of holding pan 18 to frame 11, other methods may, of course, be used. For instance, it would be possible to weld studs to the back surface 14 and, in this way, no portion of the fastener would show from the cell side.

Bolts 20 are securely held to front plate 13 by spacer nuts 22. Nut 22 is shown partially cut away in FIG. 2 and has a recess 23 which fits over the square shank 24 of bolt 20. Nut 22 is preferably a spacer nut. That is, the thickness of nut 22 is preferably made only slightly smaller than the space between back 14 and the inner surface of the pan. In this way, the tightening of nuts 25 is not capable of placing undue pressure on lens 17*b*. The distance between the inner surface of pan 18 and the outer surface of spacer nut 22 should be about 1/16 inch before nuts 25 are tightened. In FIG. 2, the lens is shown as a laminate of glass 17*b* and acrylic plastic 44.

As indicated above, pan 18 is held against the back surface of lens 17 by a plurality of nuts 25 which bear against washers 26. It is evident that it is impossible for anyone inside the cell to loosen bolts 20 since they cannot be turned from the cell, and nuts 25 are inaccessible from the cell. A substantial advantage of this design, however, is the ability to remove and replace the lens from the chase or back side of the assembly of the present invention. The nuts 25 are readily accessible from the chase and can be easily removed permitting removal of pan 18 and lens 17. The damaged lens can then readily be replaced from the chase and the assembly rebolted in a manner of minutes. Nuts 22 hold bolts 20 in the openings and thus there is no need to enter the cell for this replacement.

The steps required to provide maintenance service in a prison cell are labor intensive. First, it must be understood that prison guards or security personnel are not permitted to do service or maintenance work. Furthermore, maintenance personnel are not trained or equipped to guard prisoners. Still further, tools which are required to perform maintenance are potentially capable of being used as weapons and it thus becomes necessary for the maintenance personnel to be kept separated from prisoners. Therefore, even for a simple maintenance task it is necessary to first remove the prisoner or prisoners from the cell. Secondly, the maintenance man, accompanied by a security man enter the cell. A second security man may also be required to escort the maintenance man to the cell door. It can thus be seen that a task as ostensibly simple as changing a light bulb becomes a disruptive and labor intensive task if it must be done from within the cell. The view port of the present invention can be serviced without entering the cell.

Figure 3:
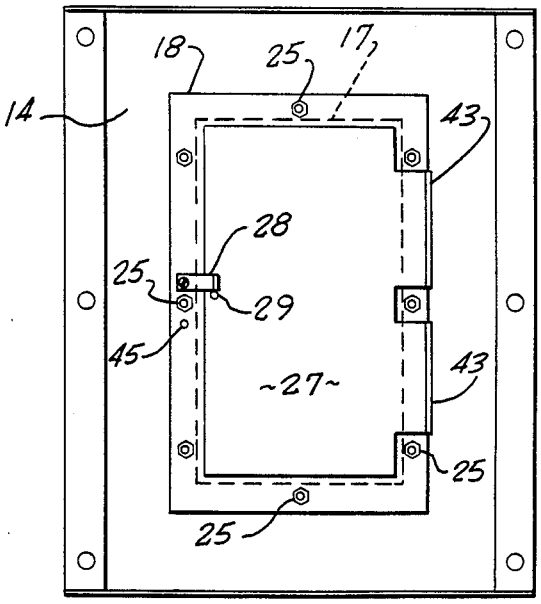
FIG. 3 is a plan view of the back of the view port of the present invention with the door in a closed position.

View port 10 is provided with a solid metal door 27 which is hingedly affixed to pan 18 by hinge 43 which is welded to one side of pan 18. A latch 28 is held to the back of pan 18 and permitted to turn so that it holds the door in a close position as shown best in FIG. 3. A spacer should be provided between the latch and the back surface of the pan so that it may fit readily over the back of door 27. A door handle 29 facilitates the opening and closing of door 27 and also provides a rest for latch 28 as shown in FIG. 3. Handle 29 is shown best in FIG. 4. A second hole 45 is formed in door 27 so that the door can be mounted with either side up.

Figure 7:
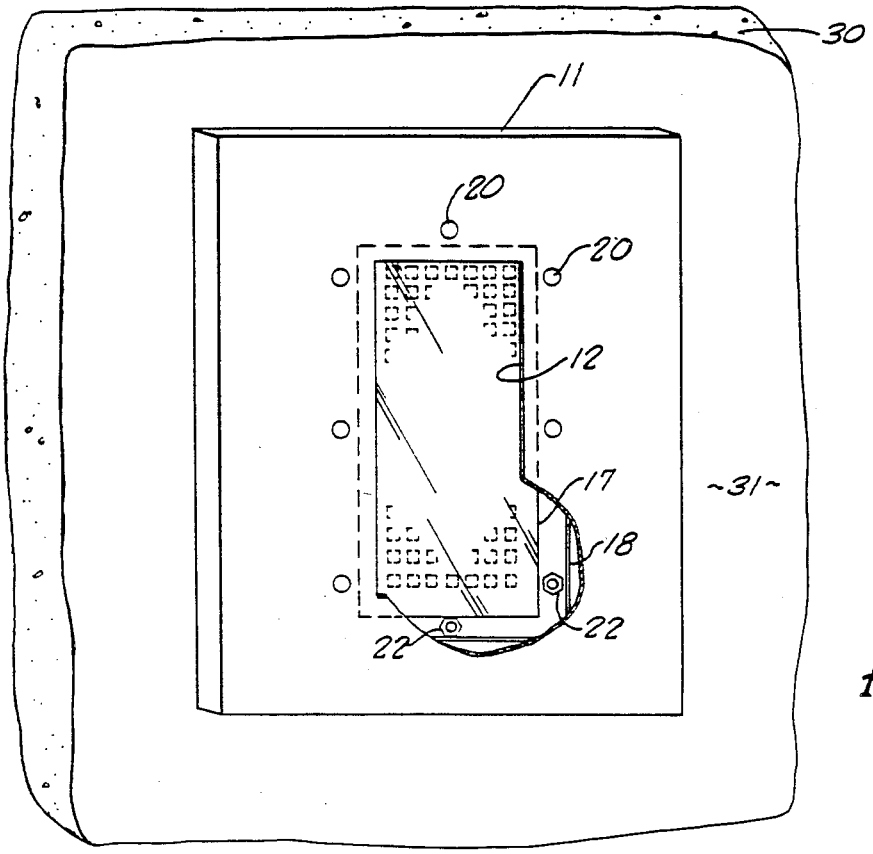
FIG. 7 is a front view of the wall and view port of FIG. 5.

Turning now to the holding of lens 17 over opening 12, lens 18 is indicated in dotted lines in FIG. 3. Lens 18 rests against the spacer nuts 22 which are held between pan 18 and the back surface 14 of the frame 11. As shown in FIG. 7, the edge of lens 17 extends past the edge of opening 12 along the entire periphery of opening 12. The amount of this extension is important since too slight an extension could cause a stress in the lens 17 which could lead to cracking or breaking. Furthermore, a too small extension of the lens past the opening increases the possibility that an opening could be formed for the passage of contraband or breaking or destruction of the lens. The amount of this overlap should be at least about $\frac{3}{8}$ of an inch and preferably about $\frac{1}{2}$ an inch around the entire periphery.

Figure 4:
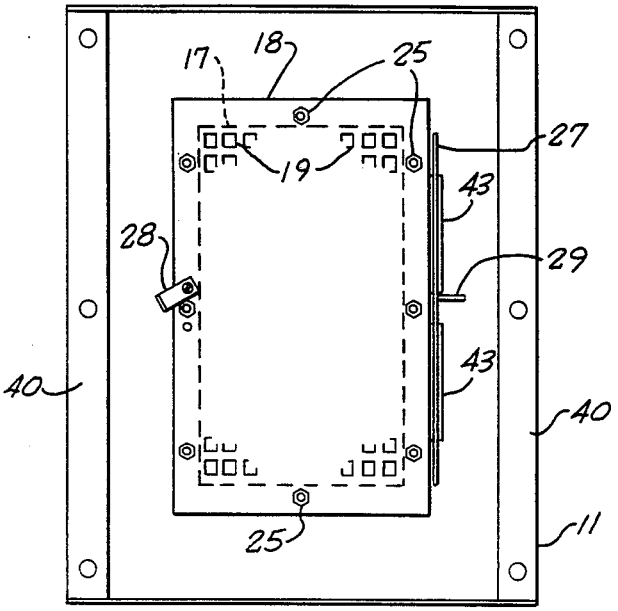
FIG. 4 is a plan view of the back of the view port of the present invention with the door in an open position.
Figure 8:
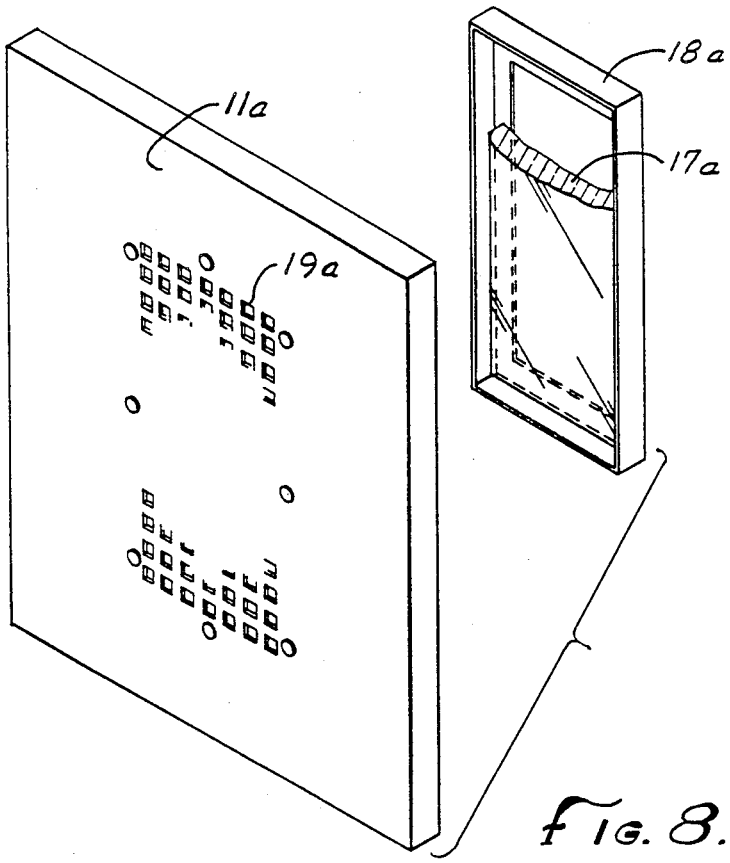
FIG. 8 is an exploded perspective view of an alternate embodiment of the view port of FIG. 1.

The view port is shown in FIG. 4 with the door open in a position for viewing the interior of the cell. Square openings 19 are, of course, exposed and permit the easy viewing through lens 17. For most installations, it is preferable that openings 19 be formed in the pan 18. In this manner the view port can be readily kept clean from inside the cell since there are no openings to interfere with cleaning the surface. In some installations, it may be preferable that the back surface be cleaned in which case pan 18 may have a single large opening and the smaller openings could be formed in the front plate 13 of the frame as shown in FIG. 8 where openings 19*a* are formed in frame 11*a*. Although more difficult to clean from the cell side, it does provide ease of cleaning from the chase side. Other installation details are not shown in FIG. 8 since they are sufficiently described above.

Figure 5:
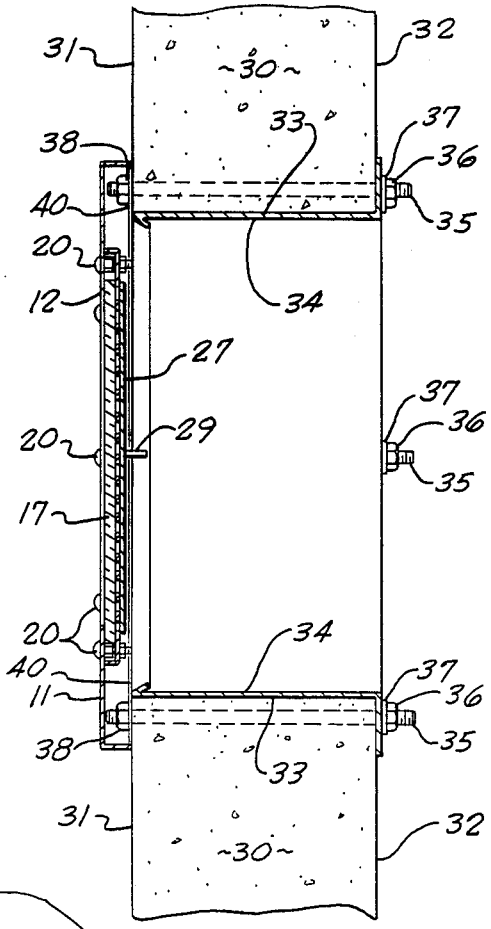
FIG. 5 is a cross-sectional side elevation of the view port of present invention affixed to a cell wall.

The view port assembly of the present invention is adapted to be mounted over an opening in the cell wall which is accessible to the chase on the side opposite the cell. A particularly secure method for mounting the assembly against the wall is shown in FIG. 5. Cell wall 30 has a cell side 31 and a chase side 32. An opening is formed through the wall and indicated by reference character 33. Opening 33 can be formed by pouring the concrete wall around an installation jig 34 which may be fabricated from galvanized steel. A plurality of tubes are also formed through the wall and permit the passage of studs 35 which are threaded into nuts 38 which are welded to the flange 40 of frame 11. This is indicated both in FIG. 5 and in the cut-away portion of FIG. 1. This provides a particularly secure attachment of the frame and virtually eliminates the possibility that contraband will be passed between the frame 11 into the opening 33 leading to the chase. Studs 35 are held against the back of the installation jig or the wall by nuts 36 which bear against washers 37.

Where the door has been shown as being hinged by a hinge welded to the side of pan 18, the hinge could, of course, be placed elsewhere. For instance, the hinge could be located on flange 40 or even on the installation jig 34. It is only important that the door be fixed so that it has a closed position where it covers the openings and an open position where it permits viewing through the openings.

Figure 6:
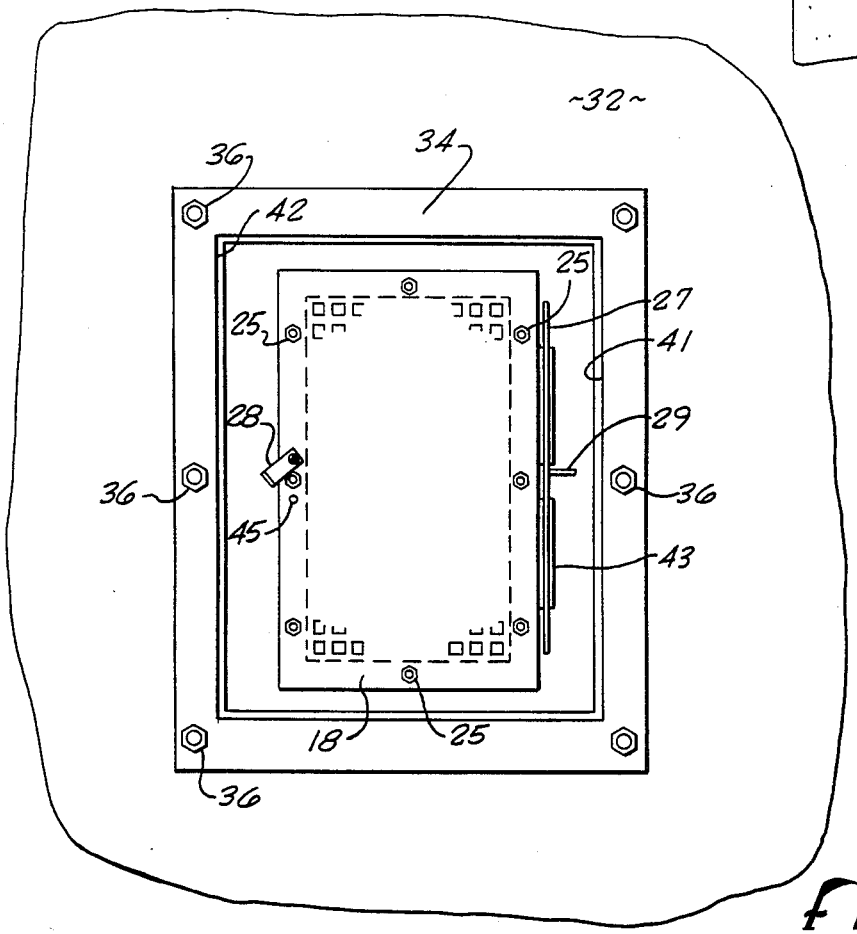
FIG. 6 is a plan view of the back of the wall and view port of FIG. 5.

An important aspect of the present invention is the ability to provide a view port even in a relatively thick wall. Prison walls are often six to eight inches in thickness and it is important that sufficient room be provided so that the guard or other person viewing the cell will have space to view all portions of the cell. The width of the opening should be at least twelve inches and preferably at least about fifteen inches. The edges of the opening are identified by reference characters 41 and 42 in FIG. 6. It can thus be seen that the ability to install a view port, which is accessible from the chase, permits the viewing of the interior of the cell without the necessity of gaining access to the cell door. Furthermore, the servicing of the view port in the event of damage to it is particularly easy because of accessibility from the chase.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. A vandal-resistant security view port assembly mounted over an opening in a cell wall for permitting observation into a cell, said view port and wall assembly comprising:

a cell wall having a thickness of at least about six inches, said cell wall having a cell surface and a chase surface and said cell wall having a generally rectangular opening therethrough, said opening being large enough to permit a viewer's head to enter said opening;

a support frame attached over said opening in said cell wall on the cell surface thereof, said support frame having a front plate having at least one opening therethrough, said front plate having a cell facing surface and a chase facing surface;

fastening means affixed to said front plate, said fastening means being affixed near the periphery of said openings;

pan means affixed to the chase facing surface of said front plate by said fastening means, said pan means having at least one opening therethrough and said pan means being supported only by said support frame;

door means hingedly held, said door means being moveable between a first position when said door means covers said opening in said pan means or said frame and a second position when it permits viewing through said opening;

lens means held against the chase surface of the front plate by said pan means, said lens means completely covering and extending past said opening in said front plate.

2. The vandal-resistant security view port assembly of claim 1 wherein said door hinge is affixed to said pan means.

3. The vandal-resistant security view port assembly of claim 1 wherein said pan means has a plurality of rectangular openings therein.

4. The vandal-resistant security view port assembly of claim 1 wherein said openings are square openings having a side of about $\frac{7}{8}$ inch space one inch apart.

5. The vandal-resistant security view port assembly of claim 1 wherein said frame has a plurality of openings.

6. The vandal-resistant security view port assembly of claim 1 wherein said fastening means comprises a spacer nut which is about 1/16 inch less in thickness than the distance between the back surface of the front plate and the interior of said pan means.

7. The vandal-resistant security view port assembly of claim 1 wherein said lens means is glass.

8. The vandal-resistant security view port assembly of claim 1 wherein said lens means is plastic.

9. The vandal-resistant security view port assembly of claim 1 wherein said lens means is a laminate formed from glass and plastic.

10. The vandal-resistant security view port assembly of claim 6 wherein said spacer nut positions said lens in place over said opening in said support frame.

11. The vandal-resistant security view port assembly of claim 1 further including latch means moveable from a first position where it permits the door means to open and a second position where it prevents the opening of the door means.

12. A vandal-resistant security view port assembly mounted over an opening in a cell wall for permitting observation into a cell, said view port assembly comprising:

a masonry or block cell wall having a thickness of at least about six inches, said wall having a cell surface and a chase surface and said wall having a generally rectangular opening therethrough, said opening being large enough to permit a viewer's head to enter said opening;

a support frame attached over an opening in said masonry or block wall on the cell surface thereof, said support frame having a front plate having at least one opening therethrough, said front plate having a cell facing surface and a chase facing surface;

fastening means affixed to said front plate, said fastening means being affixed near the periphery of said opening;

pan means affixed to the chase facing surface of said front plate by said fastening means, said pan means having at least one opening therethrough and said pan means being supported only by said support frame and not by said wall;

door means hingedly held, said door means being moveable between a first position when said door means covers said at least one opening in said pan means and a second position when it permits viewing through at least one opening in said pan means; and lens means held against the chase surface of the front plate by said pan means, said lens means completely covering and extending past said opening in said front plate.

13. The vandal-resistant security view port assembly of claim 1 wherein said opening in said wall is at least twelve inches wide.

14. The vandal-resistant security view port assembly of claim 12 wherein said frame is held to said wall by bolt means positioned through openings through said wall.

* * * * *